US006572428B1

(12) United States Patent
Weiser et al.

(10) Patent No.: US 6,572,428 B1
(45) Date of Patent: Jun. 3, 2003

(54) NOVELTIES HAVING SPRING SUPPORTED APPENDAGES

(75) Inventors: Isaac Weiser, Tarzana, CA (US); Margaret Weiser, Tarzana, CA (US); Yong-Biao Ye, Nanan (CN); Xiao-Hong Guo, Xiamen (CN); Jin-Mao Huang, Xiamen (CN)

(73) Assignee: Exhart Environmental Systems, Inc., Chatsworth, CA (US)

( * ) Notice: Subject to any disclaimer, the term of this patent is extended or adjusted under 35 U.S.C. 154(b) by 0 days.

(21) Appl. No.: 10/015,286

(22) Filed: Dec. 11, 2001

(51) Int. Cl.[7] ..... A63H 27/00

(52) U.S. Cl. ..... 446/35; 40/417; 116/169; 84/402; 446/397

(58) Field of Search ..... 446/30, 36, 35, 446/45, 61, 62, 63, 68, 268, 397; 40/417; D10/116; 116/169; 84/402

(56) References Cited

U.S. PATENT DOCUMENTS

| | | | | | |
|---|---|---|---|---|---|
| 334,812 | A | | 1/1886 | Shaw | |
| 1,077,100 | A | | 10/1913 | Sheline | |
| 1,224,044 | A | * | 4/1917 | Thurman | |
| 1,652,775 | A | * | 12/1927 | Funk et al. | |
| 1,666,543 | A | * | 4/1928 | Vincent | |
| 1,814,314 | A | * | 7/1931 | Kane et al. | |
| D148,263 | S | | 12/1947 | Wagner | D34/15 |
| 2,704,908 | A | | 3/1955 | Lamkin | 46/53 |
| 2,729,022 | A | * | 1/1956 | Polk | |
| D176,972 | S | | 2/1956 | Bennett | D52/9 |
| D191,115 | S | | 8/1961 | Okamoto | D34/2 |
| 3,290,817 | A | * | 12/1966 | Kravath | |
| 3,626,555 | A | | 12/1971 | Albertini et al. | 46/74 |
| D271,406 | S | | 11/1983 | Osborne | D21/185 |
| D274,049 | S | * | 5/1984 | Stilson | D10/116 |
| 4,654,018 | A | | 3/1987 | Farrington et al. | 446/38 |
| 4,729,748 | A | * | 3/1988 | Van Ruymbeke | 446/35 |
| 4,809,452 | A | * | 3/1989 | Brown | 40/417 |
| 4,863,413 | A | | 9/1989 | Schwarz | 446/62 |
| D315,371 | S | * | 3/1991 | Van Risseghem et al. | D21/62 |
| 5,144,764 | A | | 9/1992 | Peterson | 43/3 |
| 5,524,851 | A | * | 6/1996 | Huang | 244/153 R |
| 5,551,923 | A | | 9/1996 | Worzella | 472/137 |
| D394,463 | S | | 5/1998 | Filho | D21/93 |
| D397,541 | S | | 9/1998 | Henson | D2/899 |
| 5,960,577 | A | | 10/1999 | Walterson | 43/3 |
| 5,993,286 | A | | 11/1999 | Tacquard et al. | 446/351 |
| 6,152,799 | A | | 11/2000 | Arriola | 446/330 |
| D436,554 | S | | 1/2001 | Sheridan | D11/162 |

OTHER PUBLICATIONS www.ebay.com (see attachments).*
www.siamese–dream.com (see attachment).*
www.justwindchimes.com (see attachment).*
www.yahoo.com (see attachment).*
www.windchimespavilion.com (see attachment).*
www.amazon.com (see attachment).*
www.angelfire.com (see attachments).*
Truserv Show Ornamental Butterfly No. 1.
Truserv Show Ornamental Butterfly No. 2.

* cited by examiner

*Primary Examiner*—Derris H. Banks
*Assistant Examiner*—Jamila Williams
(74) *Attorney, Agent, or Firm*—Cislo & Thomas LLP

(57) ABSTRACT

A novelty item having extending appendages which are supported by springs so as to impart life-like movement thereto.

6 Claims, 8 Drawing Sheets

FIG. 4A
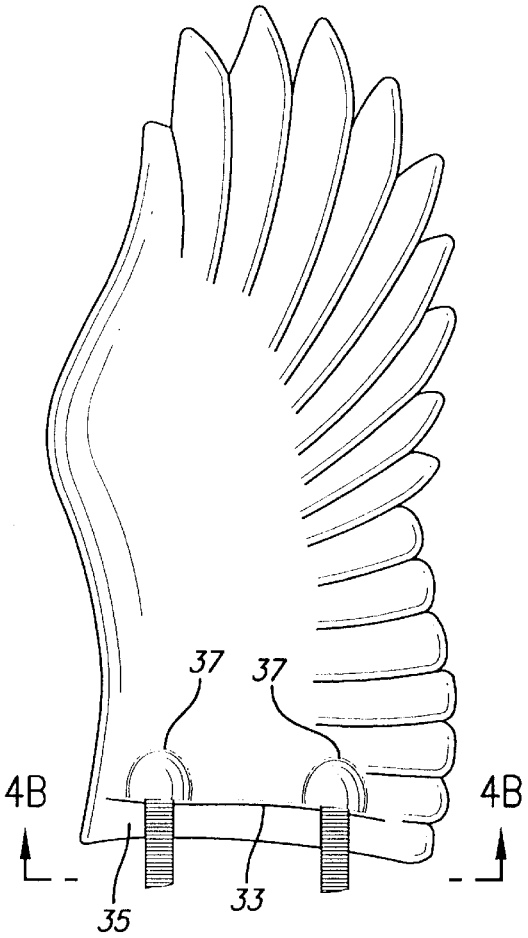
FIG. 4
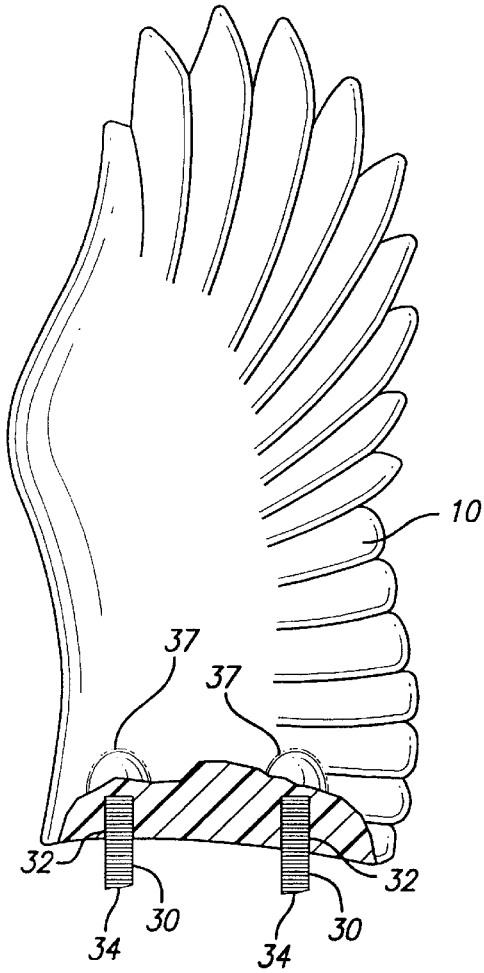
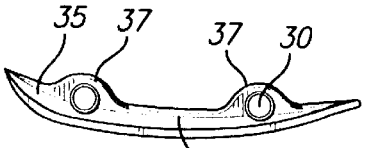
FIG. 4B
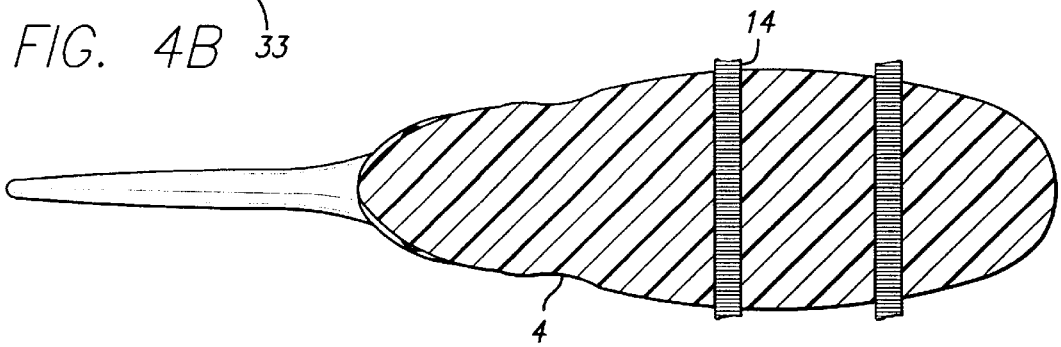
FIG. 5

NOVELTIES HAVING SPRING SUPPORTED APPENDAGES

BACKGROUND OF THE INVENTION

1. Field of the Invention

This invention relates generally to novelty items such as toys or novelties of the type that would have extending appendages that may be utilized in decorative fashion and in the specific applicability to novelties having movable wings.

2. Background of the Invention

Articulated toy figures and simulated novelty items having movable appendages are well known in the art and have been used in a variety of functions and appearances. Such figures and novelty items are generally fairly complex and require some mechanism which operates the extremities in a continual fashion or intermittently by means of electrical, mechanical, or wind power and in some instances merely by the force of gravity acting upon the toy.

The ubiquitous flying duck having a pair of wings mounted on an axle is one commonly found novelty in gardens or the like, and there are of course more sophisticated novelty items employing a wide variety of mechanisms in order to impart some type of movement to the novelty to make the novelty more interesting to watch or observe.

However, none of the prior art figures or novelty objects have been able to produce, for example simulated flapping action where the novelty item is winged which flapping is occasioned by wind acting thereon or vibrational forces exerted without the necessity of expensive and intricate mechanisms.

DESCRIPTION OF THE RELATED ART

U.S. Pat. No. 5.551,923 Issued to Worzella

This patent is directed to a simulated bird that has wind actuated flapping wings wherein the wings are attached to the body through means of bearing axels 14, 14' and which co-act with other mechanisms in order to simulate a bird or the like flapping the wings in an up and down movement when actuated by the wind.

U.S. Pat. No. 4,863,413 Issued to Schwarz

This patent is directed to a bird shaped toy glider wherein the collapsible wing structure on the body has rubber band 25 which is said to "function as a resilient spring-like means" (Col. 5 Line 40) for securing the collapsible wing structure on the body of the bird for permitting the collapsible wings to be pivoted about pin 23. While the patentee speaks about spring-like means, a rubber band is intended and certainly would not be thought of as the equivalent of a spring in accordance with the herein disclosed invention.

U.S. Pat. No. 6,152,799 Issued to Arriola

This patent is directed to a toy figure which, in the illustrated embodiment, comprises an insect to which is secured a pair of wings which are manipulated as best seen in FIGS. 1 and 2 of the drawings. The FIG. 3 drawing clearly shows a spring 74 that acts to transmit the flapping or actuating movement to the wings which are mounted through wing couplers 26 and 27 as opposed to coil springs as contemplated by the herein disclosed invention.

U.S. Pat. No. 4,654,018 Issued to Farrington et al.

This patent is directed to a creature figure toy which has an object that is seated within an enclosure formed by the wings, and to which high speed rotation can be imparted and the wings are moveable to permit exiting of the object within the toy. At Col. 5, Lines 25 et seq. there is a disclosure concerning a torsion spring 116 to bias adjacent housing structure into the opening direction to permit escape of the contained object.

U.S. Pat. No. 5,144,764 Issued to Peterson

This patent relates to a decoy type structure having a pair of wings which is attached to the body by means of strut 28.

U.S. Pat. No. 5,960,577 Issued to Walterson

This patent is directed to a drive system for animating a hunting decoy which is energized by means of a battery operated motor that employs fabric wings 16 and 18 that are fixed to mounting pegs 20 and 22.

SUMMARY OF THE INVENTION

It is a general object of the present invention to provide a novelty simulating figure having extending movable elements comprising the combination of a novelty having a body with at least a pair of extending members supported from said body in about symmetrical fashion wherein each of the pair of extending members are attached to the body through a coil spring means of a k factor low enough to allow the force of gravity or wind action to allow movement of the extending members.

It is another object of the invention to provide a novelty figure having a wing flapping motion wherein the novelty figure comprises a body having a head end and a tail end with each of a pair a wings juxtapositioned and secured to the body in a symmetrical fashion between the head end and the tail end wherein the pair of wings is supported from the body by at least one coil spring element. The coil spring element has a spring constant that allows the pair of wings to move relative to said body when a relatively low force is imparted thereto.

It is another specific object of the invention to provide a novelty figure simulating a bird wherein each of the wings of the bird are secured to the body by means of at least one coil spring so that wind action on the wings causes them to undulate or flap simulating flight of the bird.

It is also a specific object of the invention to provide a novelty simulating a bird, butterfly or other insect having wings wherein the wings are attached to the body of the simulated figure by means of at least one coil spring on each of the wings so that the wings move in an undulating or up and down fashion to simulate natural movement of a winged creature.

It is another, still more specific object of the invention to provide a lawn ornament comprising a simulated figure of a bird, insect or other creature having wings wherein each of the wings is supported by the body of the creature by at least one coil spring such that the coil spring allows for flapping or up and down movement of the wings either due to vibration or wind action on the wings.

It is another even more specific object of the invention to provide a novelty item having a pair of symmetrically supported wings wherein the wing supports are springs and wherein the novelty item has an extending rod for positioning the same in the ground, or lawn or the like.

BRIEF DESCRIPTION OF THE DRAWINGS

FIG. 3 is a front view of the novelty as depicted in FIG. 1 with the dotted line showing how the wings are movable due to wind interaction or the like.

FIG. 4 is a fragmented view of a different means of mounting the wings of a simulated novelty item wherein short coil springs are utilized;

FIG. 4A is a view of the FIG. 4 wing in full line;

FIG. 4B is view taken along the line 4B—4B of FIG. 4A;

FIG. 5 is a view through the line 5—5 of FIG. 1;

DESCRIPTION OF THE PREFERRED EMBODIMENT(S)

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention as set forth in the independent claims.

For example, while the drawings show winged simulated creatures such as birds and insects, the invention can also be extended to novelty items such as skeletons utilized at Halloween times, or other embodiments wherein appendages or extensions such as limbs or the like are secured to a body by means of coil springs having a low k factor such that slight vibrational movements or movement of the figure itself causes the appendages or extended limbs to move in an undulating or up and down fashion.

However, in the preferred embodiments as the invention is currently embodied, it will be seen that the invention is illustrated with respect to simulated winged creatures wherein the wings may be movable in a more realistic up and down fashion.

Figure 1:
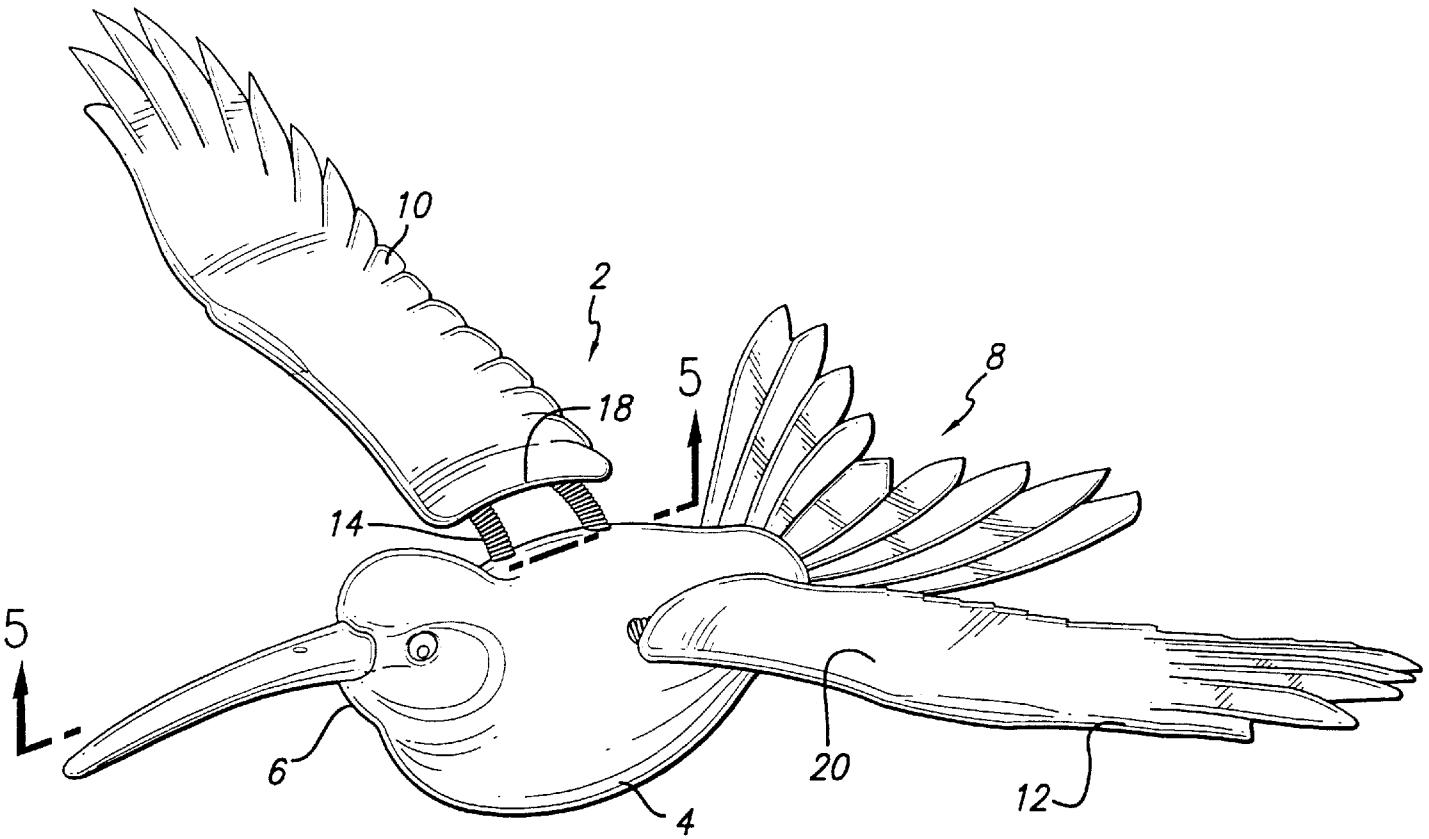
FIG. 1 is a perspective view showing one embodiment of our invention, in this instance a simulated hummingbird.
Figure 2:
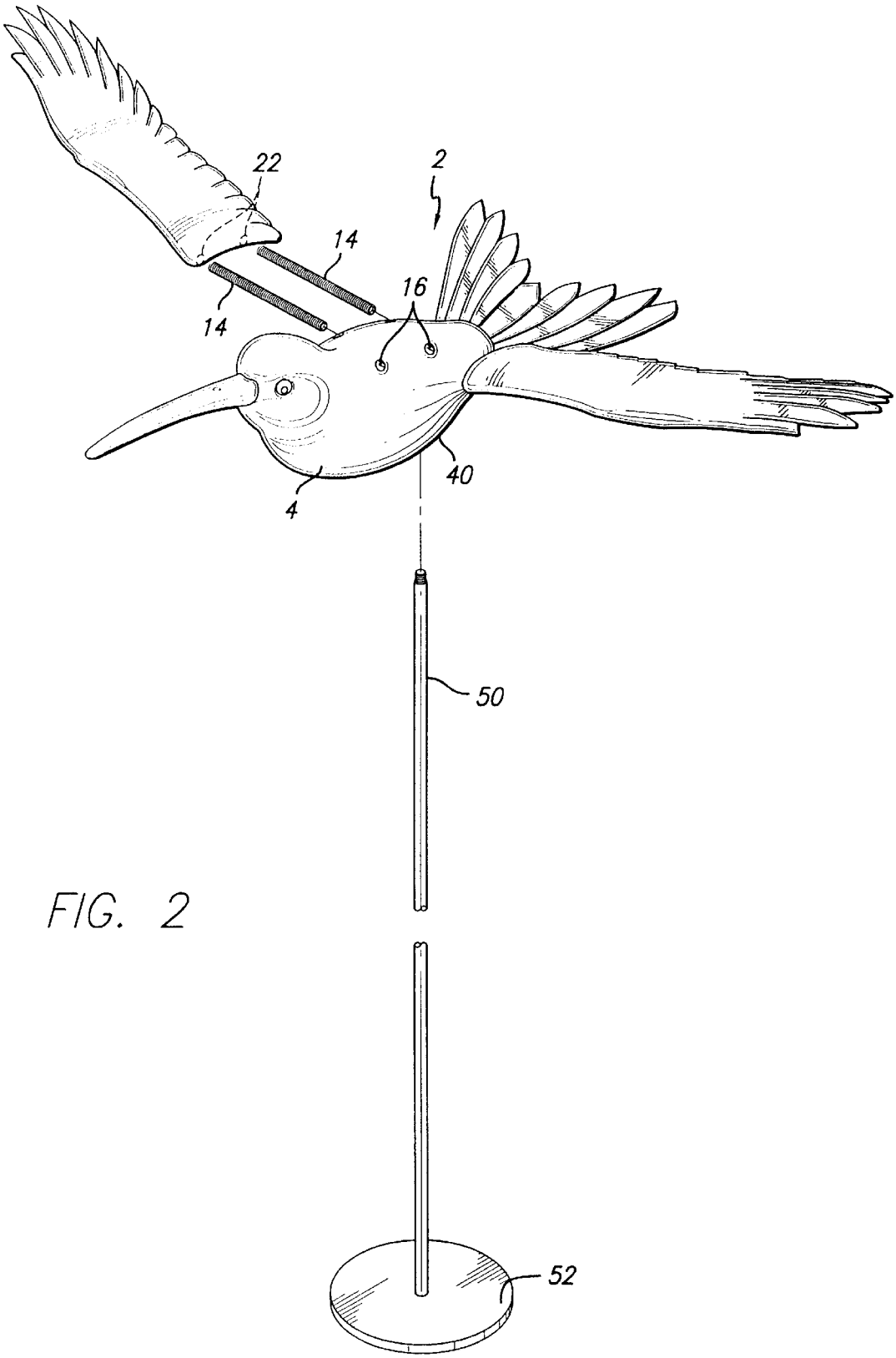
FIG. 2 illustrates the novelty item of FIG. 1 wherein more detail of construction and usage is shown.
Figure 3:
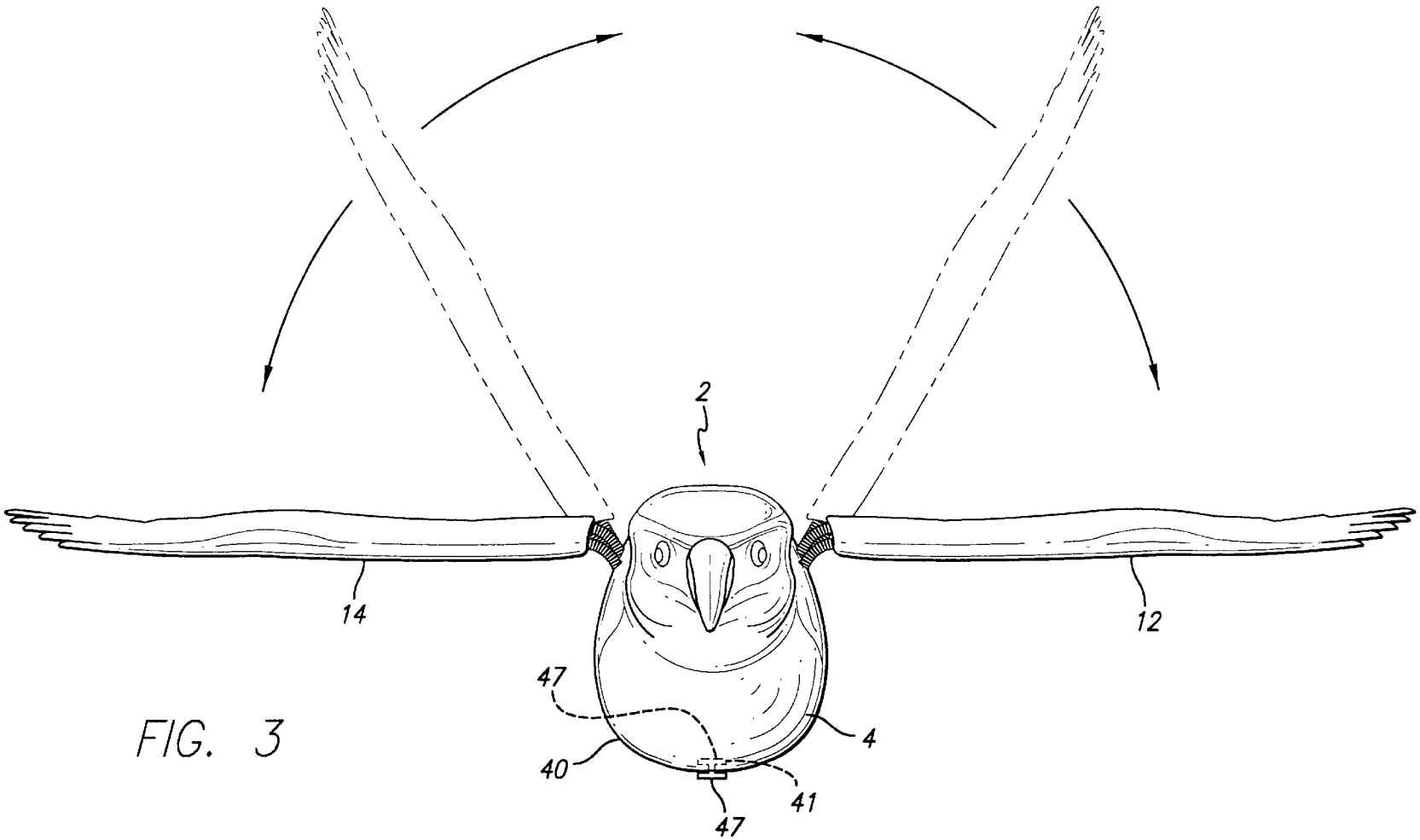

Referring now to the drawings wherein like numerals of reference illustrate like elements throughout, it will be seen that in this instance the invention is illustrated with respect to a winged bird 2 having a body 4 with a head portion 6 and a tail portion 8 and wherein a pair of wings 10 and 12 are each affixed to the body 4 by at least one spring means 14 in this particular instance comprising one elongated coil spring which extends through apertures 16 in the body 4 of bird 2. The wing end 18 of wing 10 and 20 of wing 12 are provided with aligned appropriately sized apertures, holes or recesses 22 adapted to receive the ends of coil springs 14 to be frictionally engaged and preferably cemented so that the wings 10 and 12 are adequately secured so that the wings may move in a life like up and down fashion in the direction of the arrows as shown in FIG. 3.

As seen in FIG. 4A, the wing 10 is provided with a vertical flat portion 33 forming an about right angle with horizontal wing portion 35 so that adequate clearance for the springs 30 relative to the wing 10 is obtained. Reinforced or raised portions 37 act to reinforce the connection of springs 30 to the wing 10.

The coil springs 14 as indicated extend through the body 4 as illustrated in FIG. 5. However, they need not go through the entire body of the body 4 in that, as shown in FIG. 4, the springs 30 may be short segments and secured within the recesses 32 provided in wing 10 and cemented therein, the cement not being shown for purposes of clarity. In this particular instance the spring ends 34 would be secured within recesses or apertures in the body of the winged novelty 2 as by cement or by other well known means in the art.

The under belly 40 of bird 2 may have an aperture 41 and threaded nut 43 having reinforced flanges 47 in order to receive threaded rod 50 which has support stand 52 for placement of the bird 2 on the desk, patio or any such support surface. In some instances, the stand 52 is eliminated and the end of the rod 50 is pointed so as to act as a stake so the novelty 2 may be staked into the ground, lawn or such for outside purposes.

Figure 6:
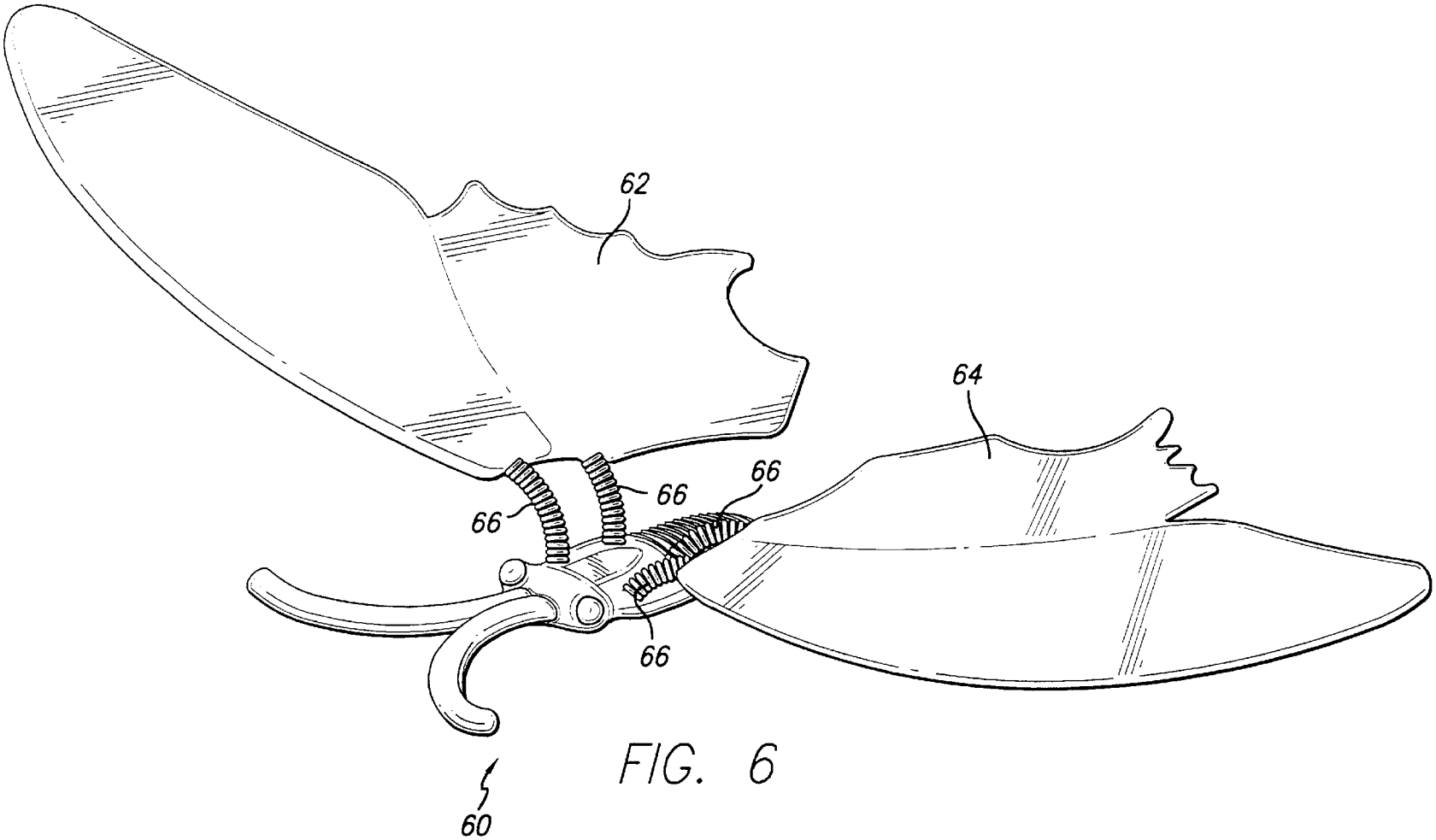
FIG. 6 is a perspective view of a simulated insect having spring supported wings.

FIG. 6 illustrates the invention as applied to an insect wherein the wings 62 and 64 are supported by somewhat longer springs 66 so as to obtain the desired end result and in this instance the coil springs 66 are slightly bent or curved so as to better simulate wing position of the insect 60.

Figure 7:
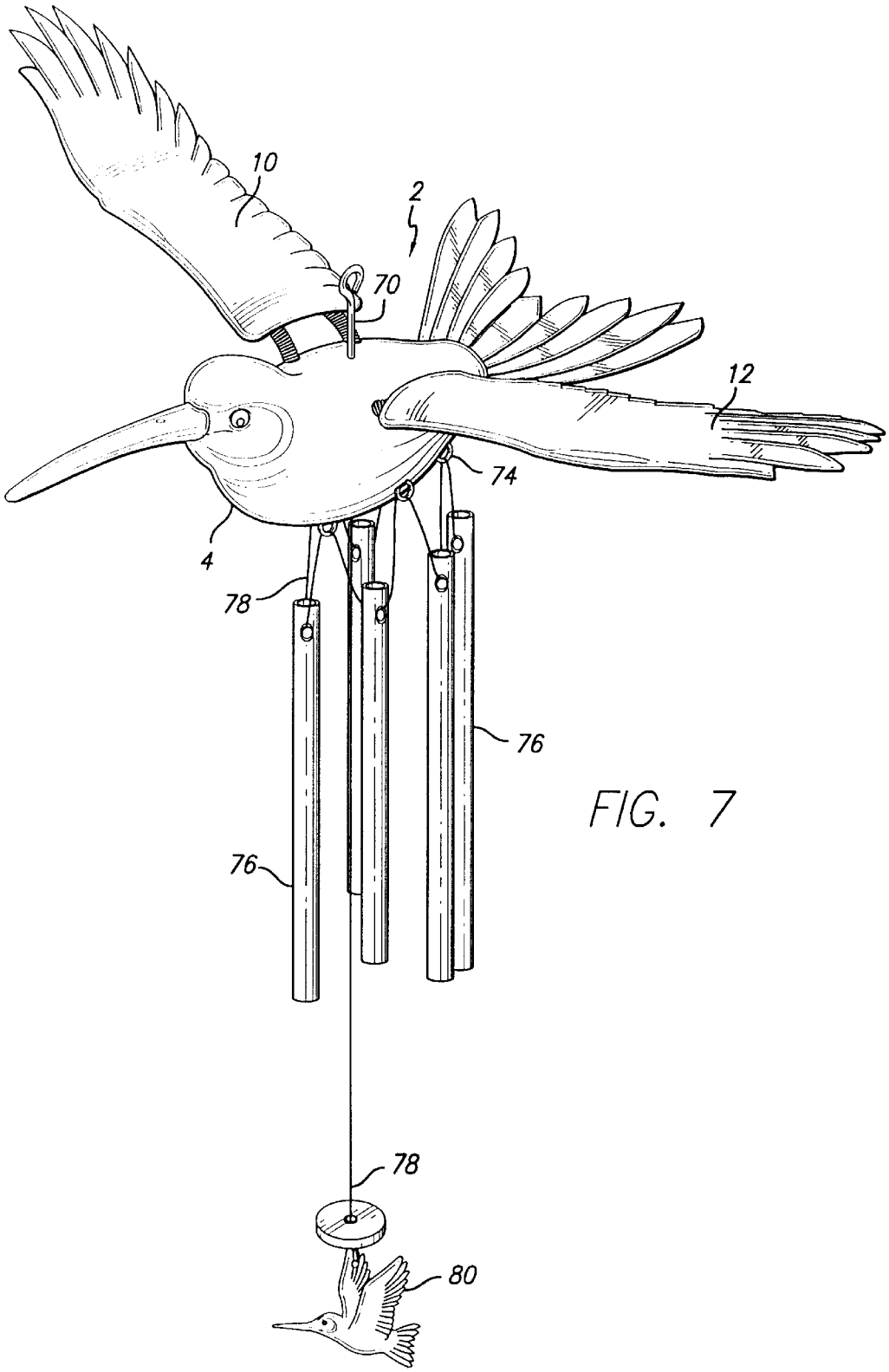
FIG. 7 is a perspective view of still another embodiment of the invention.

Referring to FIG. 7, it will be seen how the bird 2 of the invention is modified to serve a different purpose. In this instance the body 4 of bird 2 is provided with a support hanger 70 in this instance taking the form of an eyehook from which the bird 2 may be supported by means of a spring, fish line, or other means not shown. The body 4 has a number of eyehooks or staples 74 in spaced relationship from which chime elements 76 may be suspended by means of wire or in the preferred instance, fish line 78, so that wind movement not only creates movement of the wings 10 and 12, but also creates chiming sounds by reason of the chime elements 76 impacting upon one another. For stability purposes a plumb line 78 having a weight 80 taking any configuration or form may be suspended from body 4 of bird 2.

Figure 8:
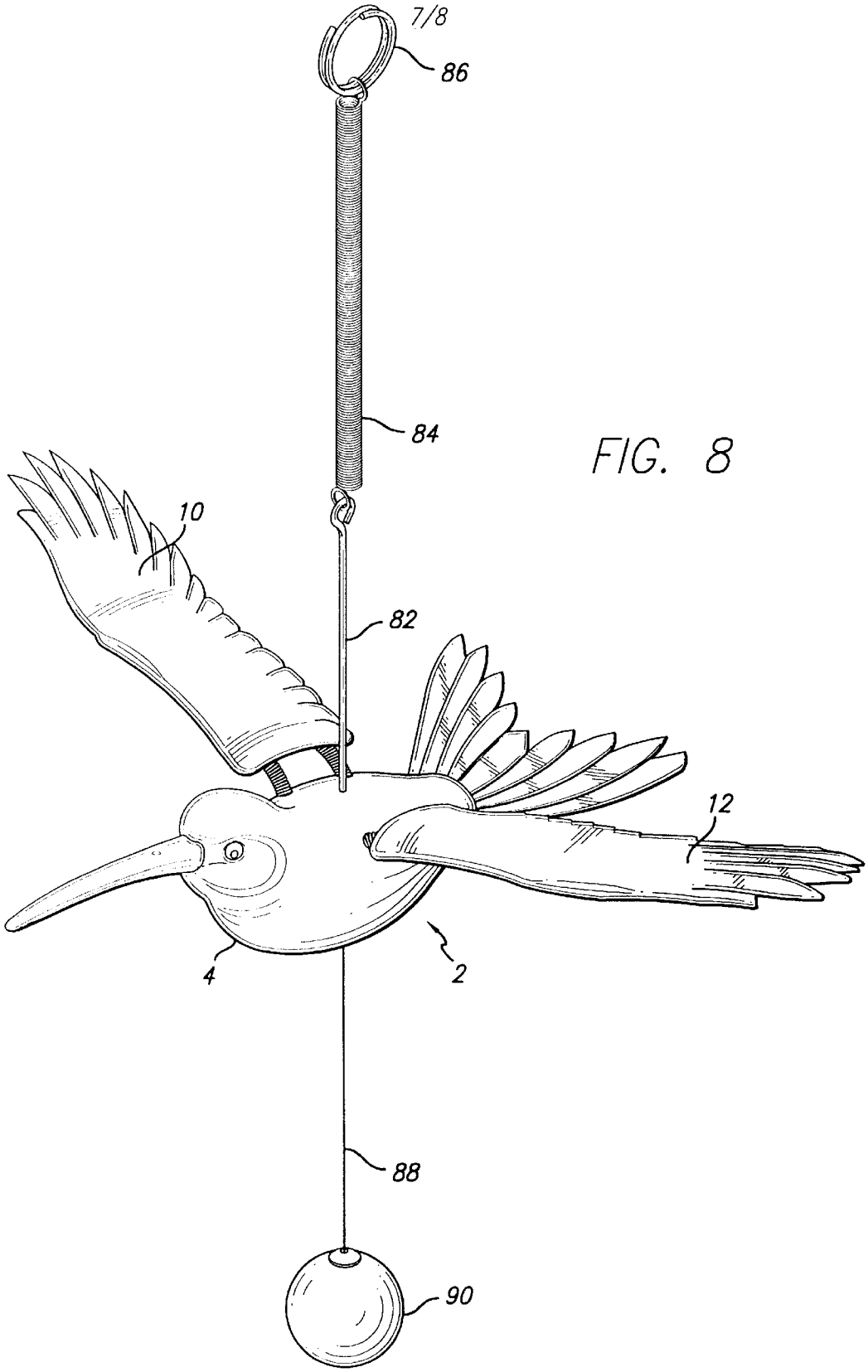
FIG. 8 is a perspective view of an alternative suspension arrangement of another embodiment of the invention.

Referring to FIG. 8, it will be noted that the bird 2 in this instance has an elongated eyehook support member 82 secured to the body 4 by means of eyehook 82 being screwed into the body 4, or alternately adhesively secured and is suspended from spring member 84 which is itself fastened to support not shown by means of a bracket or the like 86. Suspended beneath the body 4 of bird 2 is fish line 88 to which is attached suitable weight 90, in this instance taking the configuration of a sphere. In operation of this embodiment of the invention, the wind movement not only allows for the flapping action of the wings 10 and 12 of bird 2, but also permits a bounce like action to be imparted to the bird 2 by reason of spring 84, which is aided by reason of weight 90.

Figure 9:
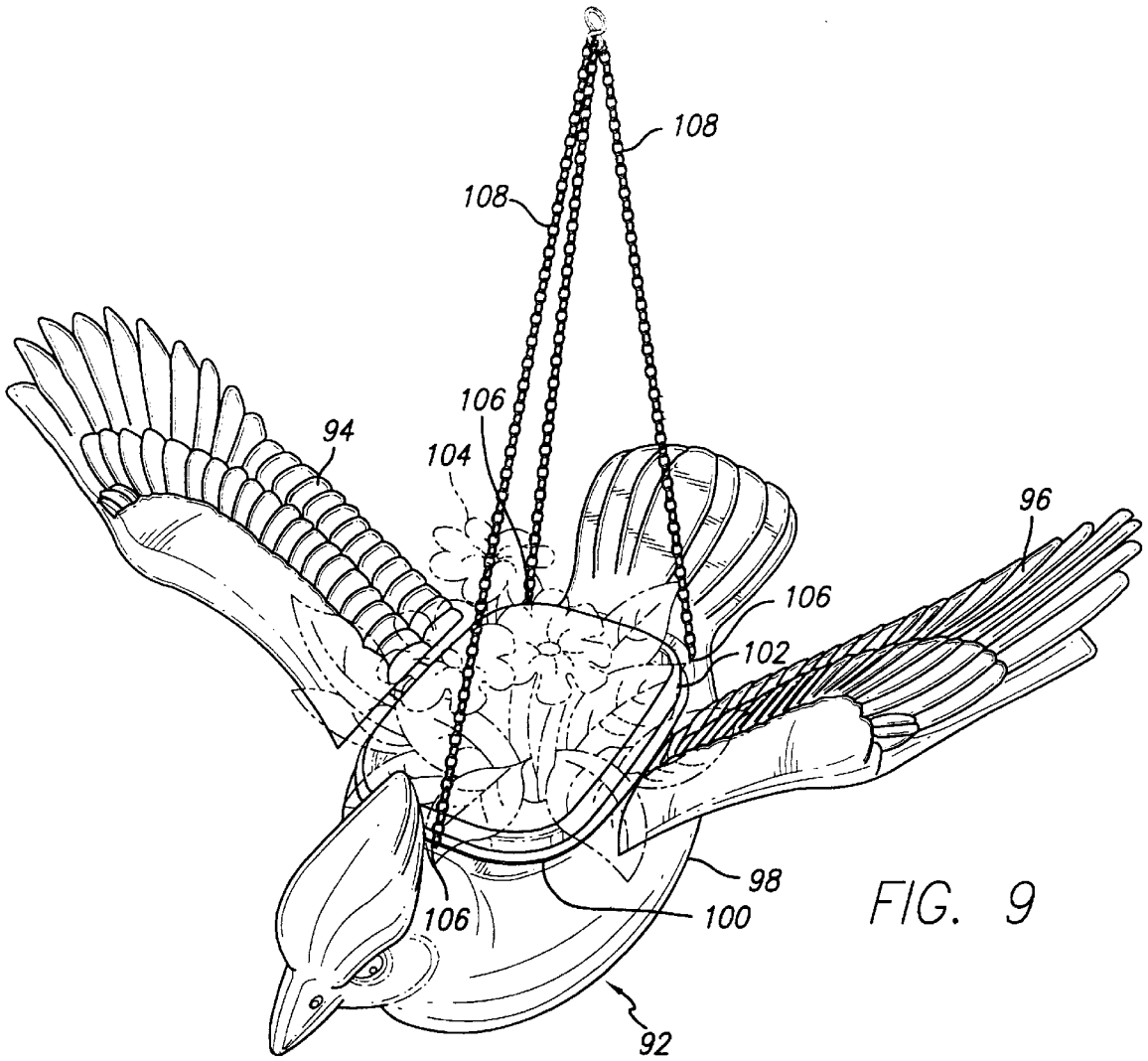
FIG. 9 is yet another modification of the invention in another embodiment.

Referring to FIG. 9, a differently configured bird 92 is illustrated in the configuration of a cardinal bird wherein the wings 94 and 96 are again supported by spring members as in the previous embodiments but in this instance the bird 92's body 98 is provided with a recess 100 which may be adapted to receive a liner 102 which is adapted to receive flowers shown in dotted line 104 for example, or alternately to receive bird seed or feed not shown so that the bird embodiment 92 acts as a bird feeder. In this instance, the body 98 is provided with fastening members 106 in order to allow attachment of chain supports 108 by which the bird 92 may be affixed to a eave or other support in proximity to a dwelling house or the like with which the novelty bird 92 is utilized.

While the body 4 of bird 2 has been shown as being solid, it is of course within the scope of the invention that there be a molded novelty item and that the body be formed so as to define an interior chamber as opposed to a solid body and those who are skilled in the art will of course recognize this deviation as not departing from the spirit of the invention.

The novelty items, because they are of a novelty nature, are generally fabricated by injection molding or the like and may be hand or otherwise decorated to simulate various winged creatures whether they be birds of various kinds and character, or any other winged creature or appendaged figure. It is only important that the wings or extending appendages be supported by at least one coil spring having a spring factor which is low enough to permit the appendages or wings to move due to vibrational forces imparted through the object or alternately as, for example where the novelty item is a bird, by reason of the wind acting on the wings so that the wings move in an up and down fashion because of the coil spring support of the wings to the body of the novelty item.

Thus, there has been disclosed a relatively low cost novelty item which simulates flapping of wings or other extending appendage movement in a low cost, with essentially a trouble free movement mechanism and wherein various changes and modifications will present themselves to those who are already skilled in the art and all such changes and modifications are intended to be covered by the appended claims.

What is claimed is:

1. A novelty simulating figure having extending movable elements comprising the combination of said novelty having a body, at least a pair of extending members supported from said body in about symmetrical fashion, each of said pair of extending members having coil spring means securing each of said pair of extending members to said body in a movable relationship therewith, the area of each said extending member adjacent said coil springs having an enlarged cross-sectional area whereby reinforcement of said extending member is obtained, each said cross-sectional area defining a bulbous protrusion disposed at least partially about each coil spring, said bulbous protrusion formed with said extending member, and wherein said protrusion is adjacent to a continuous curvilinear section of said extending member; said body having hanging means by which said novelty simulating figure may be suspended from a fixed support, wherein said hanging means comprises an eyehook and said body has a plurality of chime members suspended therefrom that allow the chime members to be freely movable under application of relatively low forces, which additionally includes a weight suspended from the underside of said body to impart stability and exciting forces thereto.

2. The novelty in accordance with claim 1 wherein said coil spring means have a spring constant that allows the extending members to be freely movable under application of relatively low forces.

3. The novelty in accordance with claim 1 wherein said coil spring means comprises metal coil springs.

4. The novelty figure in accordance with claim 1 wherein a pair of coil springs are each utilized to support each of said extending members from said body.

5. The novelty figure in accordance with claim 1 wherein said body is of molded plastic.

6. A novelty figure in accordance with claim 1 wherein said body and said at least a pair of extending members are configured to simulate a bird.

* * * * *